US007159935B2

(12) United States Patent
Lai

(10) Patent No.: US 7,159,935 B2
(45) Date of Patent: Jan. 9, 2007

(54) STRUCTURE OF A CHAIR

(76) Inventor: Chang-Cheng Lai, No. 373, Jhongjheng Rd., Ronwu Township, Kaohsiung County (TW)

( * ) Notice: Subject to any disclaimer, the term of this patent is extended or adjusted under 35 U.S.C. 154(b) by 137 days.

(21) Appl. No.: 11/098,475

(22) Filed: Apr. 5, 2005

(65) Prior Publication Data

US 2006/0220421 A1 Oct. 5, 2006

(51) Int. Cl.
*A47C 1/035* (2006.01)
*A47C 7/50* (2006.01)
*A47C 20/00* (2006.01)

(52) U.S. Cl. ..... 297/84; 297/68; 297/423.19; 297/423.26

(58) Field of Classification Search ..... 297/68, 297/84, 423.19, 423.26, 423.27
See application file for complete search history.

(56) References Cited

U.S. PATENT DOCUMENTS

| | | | | |
|---|---|---|---|---|
| 256,793 | A * | 4/1882 | Chelini | 297/423.26 X |
| 303,875 | A * | 8/1884 | Mason | 297/423.26 X |
| 378,902 | A * | 3/1888 | Pew | 297/423.26 X |
| 491,172 | A * | 2/1893 | Hart | 297/423.26 X |
| 664,933 | A * | 1/1901 | Durnell, Jr. | 297/423.26 X |
| 703,227 | A * | 6/1902 | Blackard | 297/84 |
| 1,206,669 | A * | 11/1916 | Carter | 297/84 X |
| 1,499,831 | A * | 7/1924 | Kurnick | 297/68 |
| 1,919,110 | A * | 7/1933 | Horvath | 297/84 X |
| 1,986,381 | A * | 1/1935 | Stockil | 297/423.26 X |
| 2,203,610 | A * | 6/1940 | Bascom et al. | 297/423.26 X |
| 2,507,609 | A * | 5/1950 | Miles | 297/423.26 |
| 6,390,546 | B1 * | 5/2002 | Ming | 297/68 |
| 6,402,232 | B1 * | 6/2002 | Tsai | 297/68 |
| 2002/0030389 | A1 * | 3/2002 | Panton | 297/68 |

* cited by examiner

*Primary Examiner*—Rodney B. White
(74) *Attorney, Agent, or Firm*—Rosenberg, Klein & Lee

(57) ABSTRACT

A chair includes two lateral supports, a seat connected to the lateral supports, a back, a footrest, and two pivotal bars; the seat has a loop-shape; the back is passed through the seat, and pivoted to rear upper portions of the lateral supports at a middle portion thereof; the back has several back supporting bands connected to the seat so as to be under a space within the seat; the footrest is pivotally connected to a lower end of the back at a rear end thereof; the pivotal bars are pivoted to respective ones of front portions of the lateral supports at upper ends thereof, and they are pivotally connected to a middle portion of the footrest at lower ends thereof; thus, a sitter can change the position of the back and the footrest by means of changing his/her body position.

1 Claim, 6 Drawing Sheets

STRUCTURE OF A CHAIR

BACKGROUND OF THE INVENTION

1. Field of the invention

The present invention relates to a chair, more particularly one, which is suitable for use in saunas and other recreational places, and which is structured in such a way that when the sitter changes his/her body position, the position of the back and the footrest will be changed accordingly.

2. Brief Description of the Prior Art

Referring to FIGS. 5 and 6, a conventional chair, which is especially made for use in saunas, includes two wooden lateral parts 6, a support board 7, a seat 8, and a back 9. The lateral parts 6 are secured next to a wall of a sauna, and each has a horizontal bar portions 61 on an inner side of an upper portion thereof, which bar portion 61 has a gap 62. The support board 7 is positioned between the lateral parts 6, and passed through the gaps 62 at two ends thereof. The seat 8 is supported on the horizontal bar portions 61 of the lateral parts 6. The back 9 is propped against a rear portion of the seat 8 at a lower end thereof.

The position of the back 9 can be reclined, and adjusted by means of displacing the seat 8 relative to the lateral parts 6, as shown in FIG. 6. However, the sitter has to first stand up so that the seat 8 becomes displaceable, and he/she won't know whether or not the current reclining position of the back 9 is suitable until he/she sits down on the chair. Therefore, it is possible that the sitter will have to stand up and sit down repeatedly to adjust the back 9 to a suitable position. Furthermore, the chair is made especially for use in saunas, not suitable for use in other places.

SUMMARY OF THE INVENTION

It is a main object of the invention to provide an improvement on a chair to overcome the above-mentioned problem.

The chair of the present invention includes two lateral supports, a seat connected to the lateral supports, a back, a footrest, and two pivotal bars. The seat has a loop-shape. The back is passed through the seat, and pivoted to rear upper portions of the lateral supports at a middle portion. In addition, the back has several back supporting bands connected to the seat so as to be under the space within the seat. The footrest is pivotally connected to a lower end of the back at a rear end. The pivotal bars are pivoted to respective ones of front portions of the lateral supports at upper ends, and they are pivotally connected to a middle portion of the footrest at lower ends. Thus, the position of the back and the footrest will be changed when the sitter changes his/her body position.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
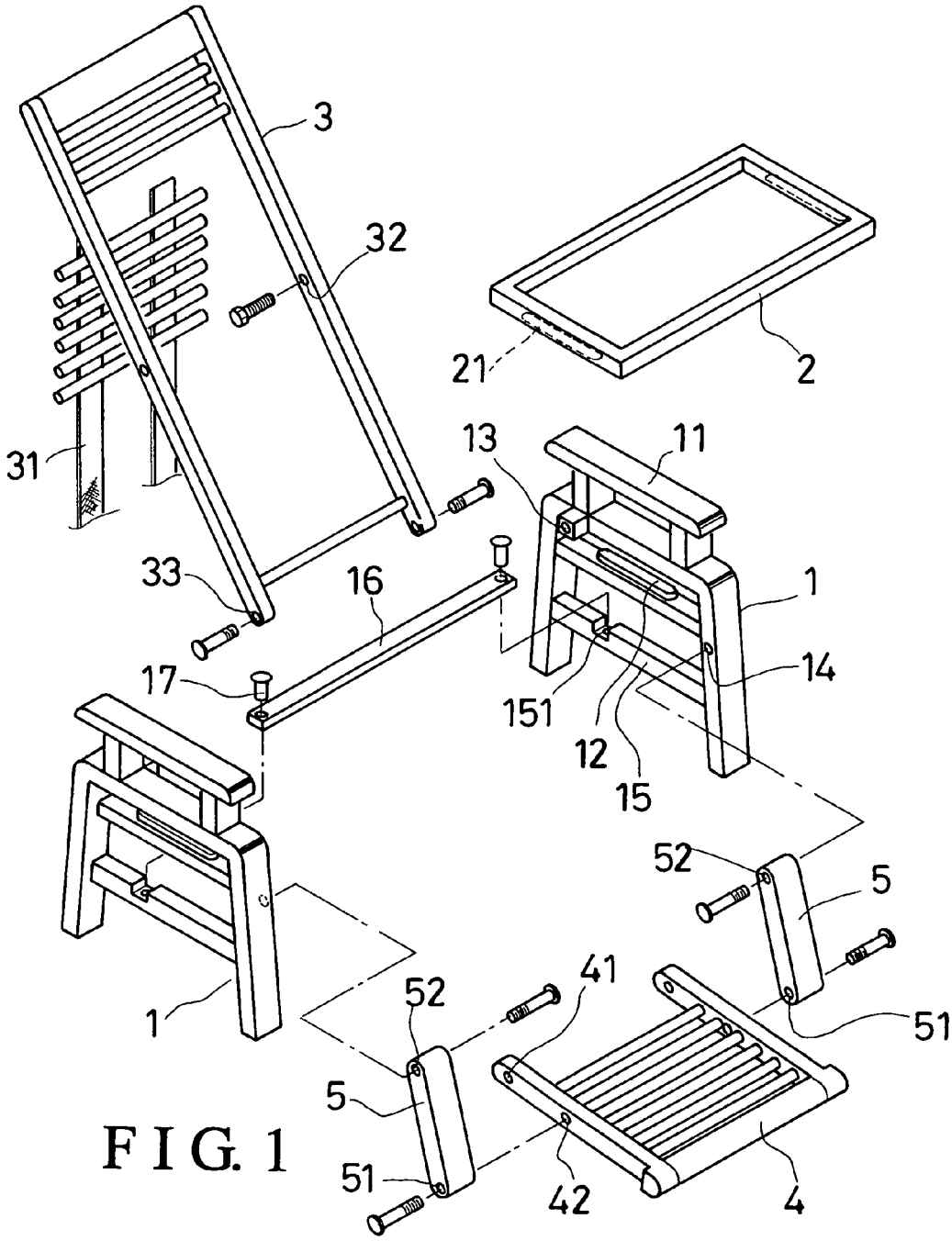
FIG. 1 is an exploded perspective view of the chair according to the present invention.
Figure 2:
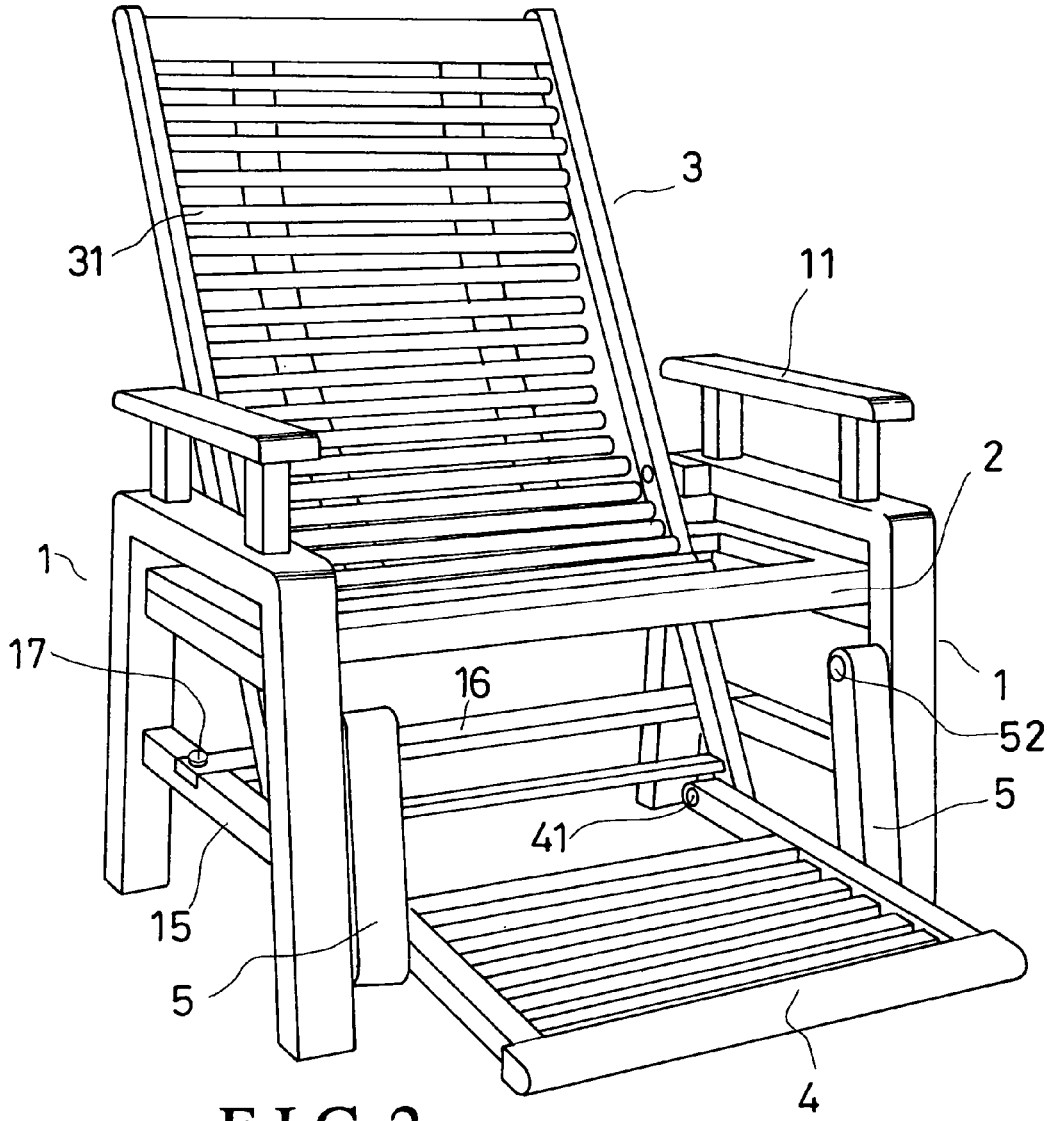
FIG. 2 is a perspective view of the chair of the present invention.

Referring to FIGS. 1 and 2, a preferred embodiment of a chair includes two lateral support members 1, a seat 2, a back 3, a footrest 4, and two pivotal bars 5.

Each of the lateral support members 1 has an armrest portion 11, a fitting protrusion 12 below the armrest portion 11, a pivotal hole 13 on a rear upper portion thereof, a pivotal hole 14 on a front portion thereof, and a transverse rod 15. The front pivotal hole 14 is lower than the rear pivotal hole 13. The transverse rod 15 has a fitting gap 151 thereon. A connecting rod 16 is fitted in the gaps 151 of the transverse rods 15 of the lateral support members 1 respectively at two ends thereof, and threaded fixing elements 17 are passed through the connecting rod 16 and the transverse rods 15 to secure the connecting rod 16 to the lateral support members 1.

The seat 2 has a loop-shape, and a fitting cavity 21 on each of left and right portions thereof. The seat 2 is connected to both of the lateral support members 1 by means of fitting the fitting protrusions 12 in respective ones of the fitting cavities 21 of the seat 2.

The back 3 has a pivotal hole 32 on a middle portion of each of left and right parts thereof, and a pivotal hole 33 on a lower end of each of the left and the right parts. The back 3 is passed through the seat 2, and pivoted to the rear pivotal holes 13 of the lateral support members 1 at the middle portion thereof by means of pivotal elements, which are passed through the pivotal holes 32 and 13. Furthermore, the back 3 has several back supporting bands 31, which are connected to the seat 2 in such a way as to be under the space within the seat 2.

The footrest 4 has a pivotal hole 41 on a rear end of each of left and right parts thereof, and a pivotal hole 42 on a middle portion of each of the left and the right parts. The footrest 4 is pivotally connected to the back 3 at the rear end thereof by means of pivotal elements, which are passed through the lower pivotal holes 33 of the back 3 as well as the rear pivotal holes 41 of the footrest 4.

Each of the pivotal bars 5 has a pivotal hole 51 at a lower end, and a pivotal hole 52 at an upper end. The pivotal bars 5 are pivoted to respective ones of the lateral support members 1 at the upper ends thereof by means of pivotal elements, which are passed though the front pivotal holes 14 of the lateral support members 1 as well as the upper pivotal holes 52 of the pivotal bars 5. Furthermore, the pivotal bars 5 are pivotally connected to the footrest 4 at the lower ends thereof by means of pivotal elements, which are passed though the middle pivotal holes 42 of the footrest 4 as well as the lower pivotal holes 51 of the pivotal bars 5.

Figure 3:
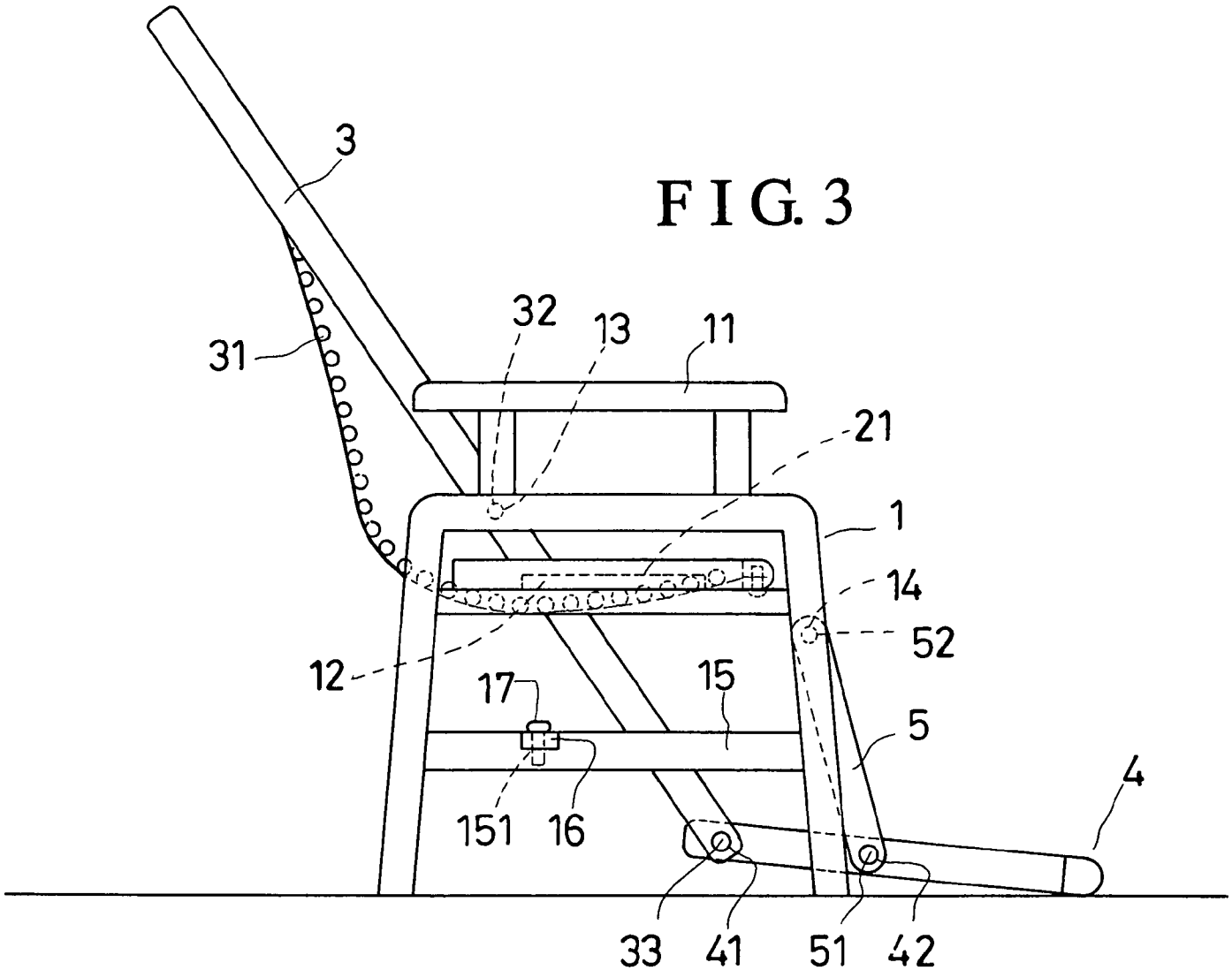
FIG. 3 is a side view of the chair of the present invention.
Figure 4:
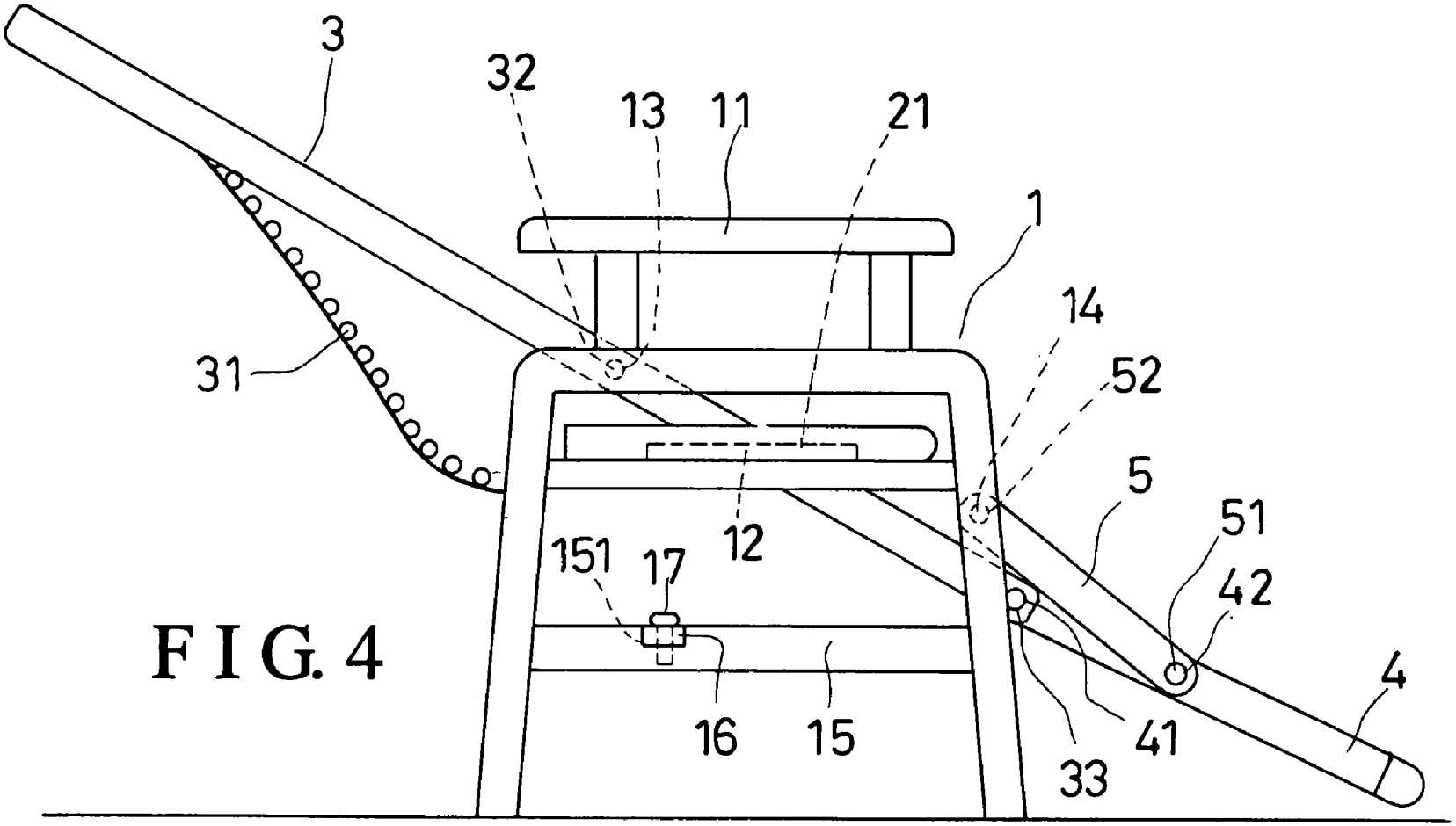
FIG. 4 is a side view of the present chair with the back moved to a more reclined position.
Figure 5:
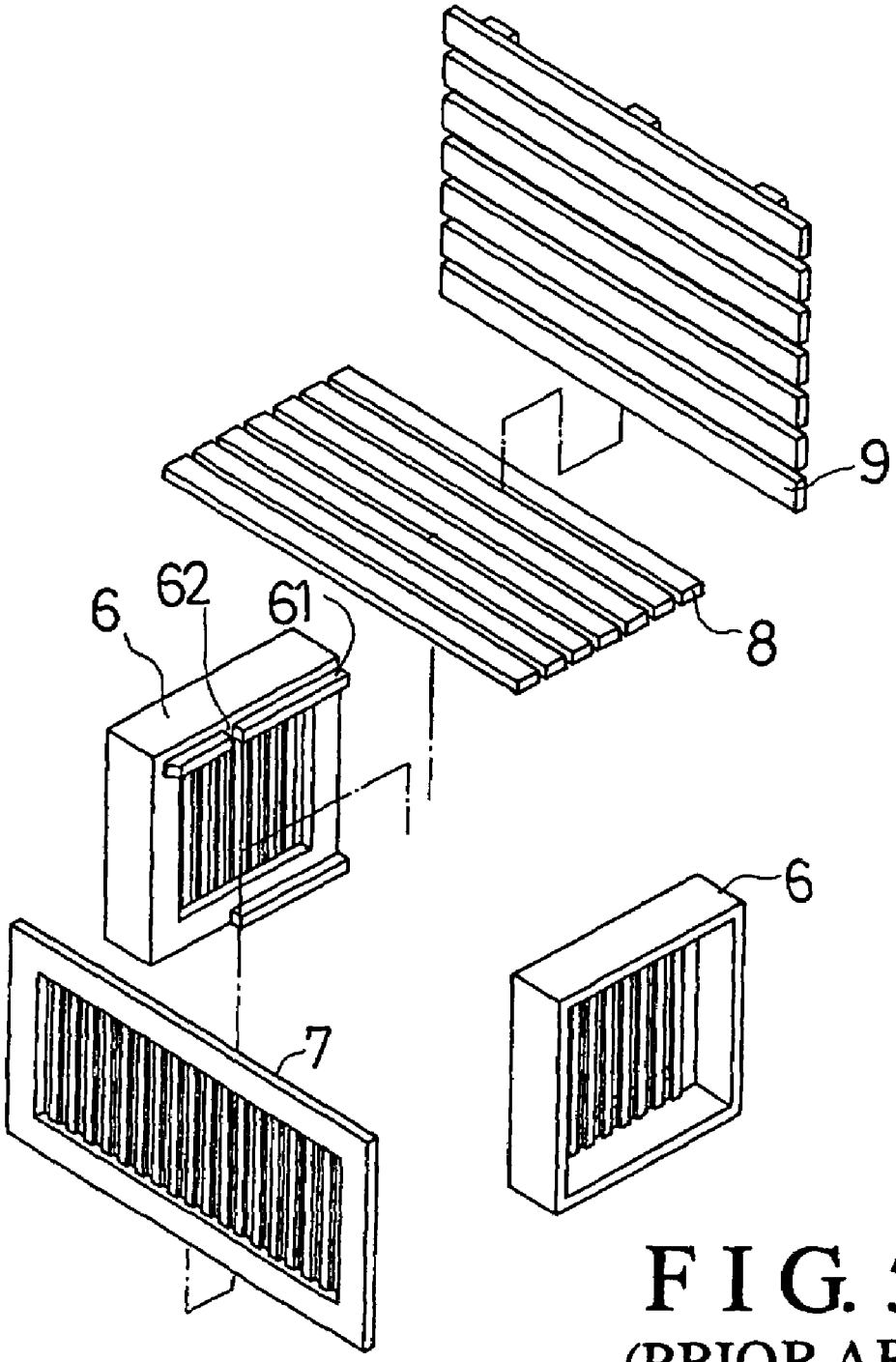
FIG. 5 (PRIOR ART)
FIG. 5 is an exploded perspective view of the conventional chair.
Figure 6:
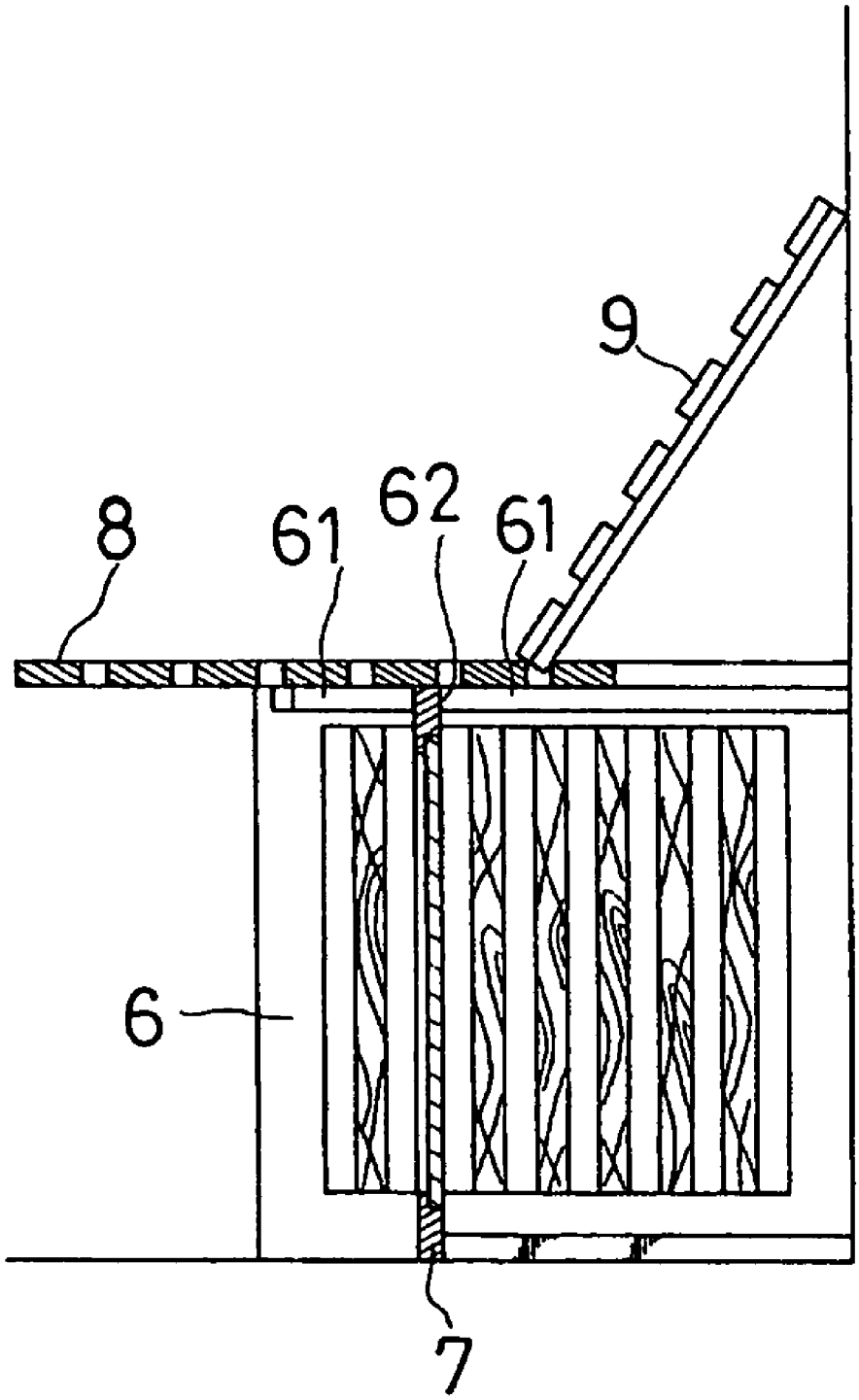
FIG. 6 (PRIOR ART)
FIG. 6 is a vertical section of the conventional chair.

Therefore, the back 3 can be angularly displaced to various positions as shown in FIGS. 3 and 4. Referring to FIG. 3, when a person keeps his back relatively upright, and sits down in the chair, the back 3 will be in a moderately reclined position, and there are moderate angles between the footrest 4 and the back 3, and between the footrest 4 and the pivotal bars 5. And referring to FIG. 4, when the sitter reclines, and pushes the upper end portion of the back 3 rearwards and downwards, the back 3 will be in a more reclined position, and the footrest 4, the back 3, and the pivotal bars 5 are nearly parallel.

From the above description, it can be easily seen that the chair of the present invention has advantages as followings:

1. The sitter is allowed to change the position of the back and the footrest of the chair merely by means of changing his/her body position. Therefore, the chair is convenient to use.

2. The chair is relatively easy to assemble.

3. Because the chair is easy to assemble, it will be easy to use in a sauna. And, it is easy for people to carry the chair when traveling. Therefore, the chair has a wider usage.

What is claimed is:

1. An improvement on structure of a chair, comprising (a) two lateral support members; each of the lateral support members having:

an armrest portion;

a fitting protrusion below the armrest portion;

a first pivotal hole on a rear upper portion;

a second pivotal hole on a front portion; and a transverse rod having a fitting gap thereon;

(b) a connecting rod fitted in the gaps of the transverse rods of the lateral support members respectively at two ends thereof, and secured to the transverse rods by means of threaded fixing elements, which are passed through the connecting rod and the transverse rods;

(c) a seat having a loop-shape; the seat having a fitting cavity on each of left and right portions thereof; the seat being connected to both of the lateral support members by means of fitting the fitting protrusions in respective ones of the fitting cavities;

(d) a back; the back having a first pivotal hole on a middle portion of each of left and right parts thereof; the back having a second pivotal hole on a lower end of each of the left and the right parts; the back being passed through the seat, and pivoted to the rear upper portions of the lateral support members at the middle portion thereof by means of pivotal elements; the back having a plurality of back supporting bands connected to the seat so as to be under a space within the seat;

(e) a footrest; the footrest having a first pivotal hole on a rear end, and a second a pivotal hole on a middle portion; the footrest being pivotally connected to the lower end of the back at the rear end thereof by means of pivotal elements; and (f) two pivotal bars; each of the pivotal bars having a pivotal hole at a lower end, and a pivotal hole at an upper end; the pivotal bars being pivoted to respective ones of the front portions of the lateral support members at the upper ends thereof by means of pivotal elements passed through the upper pivotal holes of the pivotal bars and the second pivotal holes of the lateral support members; the pivotal bars being pivotally connected to the middle portion of the footrest at the lower ends thereof.

* * * * *